US012048322B2

(12) United States Patent
Jarriault et al.

(10) Patent No.: US 12,048,322 B2
(45) **Date of Patent: *Jul. 30, 2024**

(54) METHOD FOR THE PREPARATION OF A MATERIAL CONTAINING ALKALOIDS AND AEROSOL FORMING ARTICLE COMPRISING A COMPONENT PREPARED FROM IT

(71) Applicant: PHILIP MORRIS PRODUCTS S.A., Neuchatel (CH)

(72) Inventors: Marine Jarriault, Neuchatel (CH); Celine Lesuffleur, Neuchatel (CH); Alain Sciboz, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 788 days.

This patent is subject to a terminal disclaimer.

(21) Appl. No.: 16/957,539

(22) PCT Filed: Dec. 12, 2018

(86) PCT No.: PCT/EP2018/084646

§ 371 (c)(1),
(2) Date: Jun. 24, 2020

(87) PCT Pub. No.: WO2019/129494

PCT Pub. Date: Jul. 4, 2019

(65) Prior Publication Data

US 2021/0022386 A1 Jan. 28, 2021

(30) Foreign Application Priority Data

Dec. 29, 2017 (EP) ..... 17211110

(51) Int. Cl.

| | |
|---|---|
| ***A24B 15/14*** | (2006.01) |
| ***A24B 3/14*** | (2006.01) |
| ***A24B 15/167*** | (2020.01) |

(52) U.S. Cl.
CPC ..... *A24B 15/14* (2013.01); *A24B 3/14* (2013.01); *A24B 15/167* (2016.11)

(58) Field of Classification Search
CPC ..... A24B 15/16; A24B 15/167; A24B 3/14
See application file for complete search history.

(56) References Cited

U.S. PATENT DOCUMENTS 3,098,492 A * 7/1963 Wurzburg ..... A24B 3/14 131/375
3,203,432 A 8/1965 Green
(Continued)

FOREIGN PATENT DOCUMENTS

CN 105578906 5/2016
EP 0325476 4/1992
(Continued)

OTHER PUBLICATIONS

European Notice of Opposition for Application No. 18814940.5 dated Apr. 26, 2022 (40 pages).
(Continued)

*Primary Examiner* — Christopher M Rodd
*Assistant Examiner* — Jennifer A Kessie
(74) *Attorney, Agent, or Firm* — Mueting Raasch Group

(57) ABSTRACT

The invention relates to a method for the preparation of a material containing alkaloids, said method comprising: —forming a mixture comprising a reducing sugar and particles of a material containing alkaloids; —extruding the mixture, wherein extruding includes: feeding the mixture to an extruder; heating the mixture to a first temperature lower than or equal to about 190 Celsius degrees; cooling the mixture from the first temperature to a second temperature lower than or equal to about 70 Celsius degrees; and discharging an extruded mixture from the extruder.

22 Claims, 2 Drawing Sheets

(56) References Cited

U.S. PATENT DOCUMENTS

| | | | | |
|---|---|---|---|---|
| 4,823,817 | A * | 4/1989 | Luke | A24B 3/14 131/375 |
| 5,551,450 | A | 9/1996 | Hemsley | |
| 8,931,491 | B2 | 1/2015 | Schmekel | |
| 10,660,364 | B2 | 5/2020 | Ajithkumar | |
| 10,791,756 | B2 | 10/2020 | Zuchuat | |
| 2008/0286340 | A1 | 11/2008 | Andersson | |
| 2011/0088705 | A1 | 4/2011 | Ehling | |
| 2011/0220130 | A1 | 9/2011 | Mua | |
| 2017/0035095 | A1 | 2/2017 | Zuchuat | |

FOREIGN PATENT DOCUMENTS

| | | |
|---|---|---|
| EP | 2822407 | 5/2016 |
| EP | 17211110 | 12/2017 |
| EP | 3731660 | 7/2021 |
| JP | 1-231884 | 9/1989 |
| JP | 2017-518755 | 7/2017 |
| RU | 2465904 | 11/2012 |
| UZ | 05159 | 5/2011 |
| WO | WO 2017/041920 | 3/2017 |
| WO | WO 2019/129494 | 7/2019 |

OTHER PUBLICATIONS

Office Action issued in China for Application No. 201880084618.7 dated Dec. 1, 2021 (17 pages). English translation included.

Office Action issued in Russia for Application No. 2020120708 dated May 6, 2022 (16 pages). English translation included.

Office Action issued in Japan for Application No. 2020-0535536 dated Jan. 18, 2023 (6 pages). English translation included.

PCT Search Report and Written Opinion for PCT/EP2018/084646 dated Mar. 5, 2019 (13 pages).

International Preliminary Report on Patentability for PCT/EP2018/084646 dated Mar. 31, 2020 (12 pages).

Fisher et al., "Chapter 11: Cigarette Manufacture; Tobacco Blending", Jan. 1, 1999, Tobacco: Production, Chemistry and Technology; [World Agriculture Series], Blackwell Science Ltd., Oxford, GB, pp. 346-353.

* cited by examiner

METHOD FOR THE PREPARATION OF A MATERIAL CONTAINING ALKALOIDS AND AEROSOL FORMING ARTICLE COMPRISING A COMPONENT PREPARED FROM IT

This application is a U.S. National Stage Application of International Application No. PCT/EP2018/084646 filed Dec. 12, 2018, which was published in English on Jul. 4, 2019 as International Publication No. WO 2019/129494 A1. International Application No. PCT/EP2018/084646 claims priority to European Application No. 17211110.6 filed Dec. 29, 2017.

The present invention is related to a method for producing a material containing alkaloids, such as homogenized tobacco material, and to an aerosol forming article comprising a component prepared from it.

Today, in the manufacture of tobacco products, besides tobacco leaves, also homogenized tobacco material is used. This homogenized tobacco material is typically manufactured from parts of the tobacco plant that are less suited for the production of cut filler, like, for example, tobacco stems or tobacco dust. Typically, tobacco dust is created as a side product during the handling of the tobacco leaves during manufacture.

The starting material for the production of homogenized tobacco material for aerosol-generating article may also be mostly tobacco leaves that have thus the same size and physical properties as the tobacco for the blending of cut filler.

Possible forms of homogenized tobacco material include reconstituted tobacco sheet and cast leaf. The process to form homogenized tobacco material sheets commonly comprises a step in which ground tobacco and a binder are mixed to form a slurry. The slurry is then used to create a tobacco web or sheet, for example by casting a viscous slurry onto a moving metal belt to produce so called cast leaf. Alternatively, a slurry with low viscosity and high water content can be used to create reconstituted tobacco in a process that resembles paper-making.

The tobacco present in the homogenized tobacco material may constitute the majority of the tobacco, or even substantially the total amount of tobacco present in the aerosol-generating article. The impact on the characteristics of the aerosol may therefore derive predominantly from the homogenized tobacco material.

Depending on the characteristics of the tobacco used for producing the homogenized tobacco material, it may therefore be desired to control the quantity of certain compounds in order to obtain a desired composition having specific predetermined characteristics, among others ammonia and ammonium containing compounds.

For example, due to the presence of ammonia or ammonium containing compounds, the tobacco used for producing the homogenized tobacco material may generate an aerosol with undesired flavor characteristics. It may therefore be desired to reduce the level of such ammonia and ammonium containing compounds in order to obtain a desired composition having specific predetermined flavor characteristics when an aerosol is generated from it.

Reducing the quantity of ammonia or ammonium containing compounds, however, may lead to the loss of other components of or compounds present in the material, for example alkaloids such as nicotine. There is therefore a need for a method for the preparation of a material containing alkaloids that allows controlling the characteristics of the aerosol, such as its flavor, generated from said material by lowering the quantity of ammonia or of ammonium containing compounds without causing the loss of other components of the material, and particularly of alkaloids such as nicotine.

The invention may satisfy at least one of the above needs.

According to a first aspect, the invention relates to a method for the preparation of a material containing alkaloids, said method comprising: forming a mixture comprising a reducing sugar and particles of a material containing alkaloids; extruding the mixture, wherein extruding includes: feeding the mixture to an extruder; heating the mixture to a first temperature lower than or equal to about 190 Celsius degrees; cooling the mixture from the first temperature to a second temperature lower than or equal to about 70 Celsius degrees; and discharging an extruded mixture from the extruder.

In the method of the invention, a mixture of particles of a material containing alkaloids and a reducing sugar is formed and extruded. During extrusion, the mixture is heated to a first temperature and, without being bound by theory, possibly a reaction between the reducing sugar and the material containing alkaloids, particularly with the ammonia or ammonium containing compounds comprised in the latter, occurs. The mixture is then cooled from the first temperature to a second temperature and discharged from the extruder. The reaction between the reducing sugar and the material containing alkaloids alters the composition of the material containing alkaloids, so that the resulting material discharged from the extruder has a lower quantity of ammonia or ammonium containing compounds compared to the material containing alkaloids before the extrusion. The aerosol generated from said material may therefore show desired flavor characteristics.

In the following, percentages of a compound in a mixture are related to the weight of the same (either in dry weight basis or not, depending on what is specified), that is, the percentage relates to the percent in weight of that compound on the total weight of the mixture, generally referred to "per weight" or "by weight" in literature.

As used herein, the term "sheet" denotes a laminar element having a length and length substantially greater than the thickness thereof. The width of a sheet is preferably greater than about 10 millimeters, more preferably greater than about 20 millimeters or about 30 millimeters. Even more preferably, the width of the sheet is comprised between about 100 millimeters and about 300 millimeters.

A "material containing alkaloids" is a material which contains one or more alkaloids. The alkaloids may comprise nicotine. The nicotine may be found, for example, in tobacco.

Alkaloids are a group of naturally occurring chemical compounds that mostly contain basic nitrogen atoms. This group also includes some related compounds with neutral and even weakly acidic properties.

Some synthetic compounds of similar structure are also termed alkaloids. In addition to carbon, hydrogen and nitrogen, alkaloids may also contain oxygen, sulfur and, more rarely, other elements such as chlorine, bromine, and phosphorus.

Alkaloids are produced by a large variety of organisms including bacteria, fungi, plants, and animals. They can be purified from crude extracts of these organisms by acid-base extraction. Caffeine, nicotine, theobromine, atropine, tubocurarine are examples of alkaloids.

As used herein, the term "homogenised tobacco material" denotes material formed by agglomerating particulate tobacco, which contains the alkaloid nicotine. The material containing alkaloids can thus be a homogenised tobacco material.

The most commonly used forms of homogenized tobacco material is reconstituted tobacco sheet and cast leaf. The process to form homogenized tobacco material sheets commonly comprises a step in which tobacco dust and a binder are mixed to form a slurry. The slurry is then used to create a tobacco web. For example by casting a viscous slurry onto a moving metal belt to produce so called cast leaf. Alternatively, a slurry with low viscosity and high water content can be used to create reconstituted tobacco in a process that resembles paper-making.

The sheet material of tobacco can be referred to as a reconstituted sheet material and formed using particulate tobacco (for example, reconstituted tobacco) or a tobacco particulate blend, a humectant and an aqueous solvent to form the tobacco composition. This tobacco composition may then be casted, extruded, rolled or pressed to form a sheet material from the tobacco composition. The sheet of tobacco can be formed utilizing a wet process, where tobacco fines are used to make a paper-like material; or a cast leaf process, where tobacco fines are mixed together with a binder material and cast onto a moving belt to form a sheet.

The sheet of homogenized tobacco material may be then rolled in bobbins which needs to be unwound in order to be further processed, to be part for example of an aerosol-forming article, that is to be included in the aerosol-forming substrate of the aerosol-forming article. In a "heat-not-burn" aerosol-generating article, an aerosol-forming substrate is heated to a relatively low temperature, in order to form an aerosol but prevent combustion of the tobacco material. Further, the tobacco present in the homogenized tobacco sheet is typically the only tobacco, or includes the majority of the tobacco, present in the homogenized tobacco material of such a "heat-not-burn" aerosol-generating article. This means that the aerosol composition that is generated by such a "heat-not-burn" aerosol-generating article is substantially only based on the homogenized tobacco material.

As used herein, the term "aerosol forming material" denotes a material that is capable of releasing volatile compounds upon heating to generate an aerosol. Tobacco, together with other compounds, may be classed as an aerosol forming material, particularly a sheet of homogenized tobacco comprising an aerosol former. An aerosol forming substrate may comprise or consist of an aerosol forming material.

The homogenized tobacco material includes certain compounds that contribute—among other things—to the characteristics of the aerosol, for example its flavor, generated from said material. Compounds that contribute to the characteristics of the aerosol include—among others—ammonia and ammonium containing compounds.

In order to control the quantity of such compounds in the final product and therefore characteristics of the aerosol, a method for the preparation of a material containing alkaloids is provided. These characteristics may include for example the flavor of the aerosol generated from the homogenized tobacco material.

A mixture of particles of a material containing alkaloids and a reducing sugar is formed. The mixture can be formed by any means. It may be stirred or not. This mixture is then extruded. When subjected to treatment in the extruder, the reducing sugar may react with the ammonia or ammonium containing compounds of the material containing alkaloids. Without willing to be bound to any specific theory, in the conditions of method of the invention it is believed that the carbonyl group of the reducing sugar of the mixture undergo so called Maillard reactions with the amino group of ammonia or of ammonium containing compounds of the material containing alkaloids, thus lowering their quantity.

In order to avoid, or at least to limit an undesired loss of other desired components of the material, and particularly of alkaloids such as nicotine, according to the invention the extrusion comprises a heating step of the mixture to a first temperature between lower than or equal to about 190 Celsius degrees and a cooling step of the mixture from the first temperature to a second temperature lower than or equal to about 70 Celsius degrees.

In this way, the material discharged from the extruder may comprise a lower quantity of ammonia or ammonium containing compounds compared to the material containing alkaloids before the extrusion, without any undesired loss of other components of the material, and particularly of alkaloids such as nicotine.

The extruded mixture may have the second temperature when discharged from the extruder.

Thus, a material containing alkaloids having a desired composition that allows controlling the characteristics of the aerosol generated from said material is obtained.

Preferably, the mixture, before the step of extruding, comprises between about 2 percent and about 30 percent per weight of reducing sugar, on dry weight basis of the mixture, more preferably between about 5 percent and about 25 percent per weight on dry weight basis of the mixture, more preferably between about 10 percent and about 15 percent per weight on dry weight basis of the mixture, and even more preferably between about 11 percent and about 14 percent per weight on dry weight basis of the mixture.

This amount of reducing sugar has proven to be optimal to obtain the desired characteristics in the final product.

Preferably, the particles of the material containing alkaloids have a mean size comprised between about 0.02 millimetres and about 0.3 millimetres. More preferably, the mean size is comprised between about 0.03 millimetres and about 0.15 millimetres.

The mean size of between about 0.02 millimetres and about 0.3 millimetres represents the size at which the tobacco cells are at least in part destroyed. The use of a material containing alkaloids having such a mean size, advantageously leads to a slurry smooth and uniform in the downstream processing steps of the material containing alkaloids.

Preferably, the reducing sugar is selected from glucose, fructose, xylose, ribose, galactose, and mixtures thereof. More preferably, the reducing sugar is glucose, fructose and mixtures thereof.

Preferably, the reducing sugar is mixed with the material containing alkaloids in powder form, in liquid form or in slurry form.

The material containing alkaloids can be in any desired form before mixing with the reducing sugars. Possibly, water is added in case the material containing alkaloids is substantially dry.

Preferably, before the step of extruding, the mixture has a water content of between about 2 percent and about 30 percent per weight, more preferably of between about 5 percent and about 25 percent per weight more preferably between about 10 percent and about 20 percent per weight, more preferably between about 11 percent and about 18 percent per weight and even more preferably between about 11 percent and about 14 percent per weight.

The water content of the mixture may influence the reaction between the reducing sugar and the ammonia or ammonium containing compounds within the extruder and therefore it may be a relevant factor.

Preferably, the mixture has a residence time in the extruder comprised between about 10 seconds and about 80 seconds, more preferably between about 10 seconds and about 60 seconds, more preferably between about 15 seconds and about 50 seconds, more preferably between about 20 seconds and about 30 seconds and even more preferably between about 22 seconds and about 27 seconds.

The residence time in the extruder may influence the reaction between the reducing sugar and the ammonia or ammonium containing compounds and particularly the extent of the loss of other desired components, including alkaloids such as nicotine, and therefore it may be a relevant factor.

In the process of the invention, the extent of the loss of desired components, including alkaloids such as nicotine, may depend on the residence time of the mixture within a part of the extruder, because it influences the speed of the reaction between the reducing sugar and the ammonia or ammonium containing compounds.

Preferably, heating is carried out in a first part of the extruder and cooling is carried out in a second part of the extruder, the second part of the extruder being downstream to the first part of the extruder in the direction of extrusion.

Preferably, heating the mixture to a first temperature is carried out before the step of cooling the mixture from the first temperature to a second temperature along the extruding direction.

As used herein, the term "direction of extrusion" denotes the direction of flow of the material undergoing extrusion within the extruder. Preferably, the mixture has a residence time in the first part of the extruder comprised between about 2 seconds and about 60 seconds, more preferably between about 10 seconds and about 40 seconds, more preferably between about 14 seconds and about 35 seconds, even more preferably between about 18 seconds and about 22 seconds.

The first part of the extruder is that part of the extruder where the mixture is heated.

Preferably, the mixture has a residence time in the second part of the extruder comprised between about 2 seconds and about 60 seconds, more preferably between about 10 seconds and about 40 seconds, more preferably between about 14 seconds and about 35 seconds, even more preferably between about 18 seconds and about 22 seconds. The second part of the extruder is that part of the extruder where the mixture is cooled.

Preferably, the extruder includes a cylinder and a die. The die is mounted at one end of the cylinder. The first and second part where the mixture is heated and then cooled are both formed in the cylinder.

Preferably, the extrusion process includes keeping the mixture at the first temperature for a residence time between about 2 seconds and about 55 seconds before the step of cooling the mixture, more preferably between about 6 seconds and about 26 seconds, even more preferably between about 7 seconds and about 11 seconds. In the process of the invention, the thermal profile in the extruder may influence the reaction between the reducing sugar and the ammonia or ammonium containing compounds, and therefore it may be a relevant factor.

Preferably, the method of the invention comprises heating the mixture to a first temperature between about 90 Celsius degrees and about 190 Celsius degrees, more preferably between about 140 Celsius degrees and about 190 Celsius degrees, even more preferably between about 175 Celsius degrees and about 185 Celsius degrees.

Preferably, the method of the invention comprises cooling the mixture from the first temperature to a second temperature between about 30 Celsius degrees and about 70 Celsius degrees, more preferably between about 35 Celsius degrees and about 50 Celsius degrees, even more preferably between about 35 Celsius degrees and about 45 Celsius degrees.

In the method of the invention, other processing conditions, such as the mechanical energy applied during the extrusion, may also be relevant factors for the overall result of the method of the invention, since they also influence the reaction between the reducing sugar and the compounds of the material containing alkaloids.

Preferably, the method of the invention comprises heating the mixture to a first temperature between about 175 Celsius degrees and about 185 Celsius degrees and the mixture has a residence time in the first part of the extruder comprised between about 18 seconds and about 22 seconds.

Preferably, the method of the invention comprises cooling the mixture from the first temperature to a second temperature between about 35 Celsius degrees and about 45 Celsius degrees and the mixture has a residence time in the second part of the extruder comprised between about 18 seconds and about 22 seconds.

Preferably, in the method of the invention extruding is performed by applying to the mixture a mechanical energy between about 150 watt-hour per kilogram of the mixture and about 350 watt-hour per kilogram of the mixture, more preferably between about 200 watt-hour per kilogram of the mixture and about 300 watt-hour per kilogram of the mixture, and even more preferably between about 225 watt-hour per kilogram of the mixture and about 275 watt-hour per kilogram of the mixture.

Preferably, the method of the invention comprises: combining the material containing alkaloids with a binder to form a slurry; homogenizing the slurry; and casting the slurry.

Preferably, the extrusion disclosed above is part of a process to form a cast sheet. The extrusion, which is preferably performed, before the casting, may alter some characteristics of the material containing alkaloids which is used to form the slurry to be cast. The extrusion therefore may alter characteristics of the cast sheet resulting at the end of the casting process.

Preferably, the step of combining the material containing alkaloids with a binder comprises adding the binder in an amount of between about 1 percent and about 12 percent per weight on dry weight basis of the slurry, more preferably between about 4 percent and about 10 percent in dry weight basis of the dry weight of the slurry and even more preferably between about 5 percent and about 7 percent.

The binder used in the slurry may be any of the gums or pectins described herein. The binder may ensure that the particles of material containing alkaloids remain substantially dispersed throughout the cast sheet. For a descriptive review of gums which can be used as a binder, see Gums And Stabilizers For The Food Industry, IRL Press (G. O. Phillip et al. eds. 1988); Whistler, Industrial Gums: Polysaccharides And Their Derivatives, Academic Press (2d ed. 1973); and Lawrence, Natural Gums For Edible Purposes, Noyes Data Corp. (1976).

Although any binder may be employed, preferred binders are natural pectins, such as fruit, citrus or tobacco pectins; guar gums, such as hydroxyethyl guar and hydroxypropyl guar; locust bean gums, such as hydroxyethyl and hydroxypropyl locust bean gum; alginate; starches, such as modified or derivitized starches; celluloses, such as methyl, ethyl, ethylhydroxymethyl and carboxymethyl cellulose; tamarind gum; dextran; pullalon; konjac flour; xanthan gum and the like. The particularly preferred binder for use in the present invention is guar.

Preferably, the slurry has a water content of between about 10 percent and about 90 percent per weight, more preferably between about 20 percent and about 80 percent per weight, even more preferably between about 40 percent and about 80 percent per weight, even more preferably between about 60 percent and about 80 percent before the step of casting.

The extruded mixture comprises preferably between about 45 percent and about 93 percent in dry weight basis of material containing alkaloids.

Preferably, the method of the invention comprises adding cellulose fibres to the material containing alkaloids.

Cellulose fibres may be introduced in the slurry. The introduction of cellulose fibres in the slurry typically increases the tensile strength of the material containing alkaloids, acting as a strengthening agent.

Therefore, adding cellulose fibres may increase the resilience of the material containing alkaloids web.

Cellulose fibres for adding to a material containing alkaloids such as homogenised tobacco material are known in the art and include, but are not limited to: soft-wood fibres, hard wood fibres, jute fibres, flax fibres, tobacco fibres and combination thereof. In addition to pulping, the cellulose fibres might be subjected to suitable processes such as refining, mechanical pulping, chemical pulping, bleaching, sulphate pulping and combination thereof.

Cellulose fibres may include tobacco stem materials, stalks or other tobacco plant material. Preferably, cellulose fibres such as wood fibres comprise a low lignin content. Alternatively fibres, such as vegetable fibres, may be used either with the above fibres or in the alternative, including hemp and bamboo.

The length of cellulose fibres is advantageously between about 0.2 millimetres and about 4 millimetres. Preferably, the mean length per weight of the cellulose fibres is between about 1 millimetre and about 3 millimetres.

Further, preferably, the amount of the cellulose fibres added to the material containing alkaloids in addition to the cellulose fibers already present in the latter is comprised between about 1 percent and about 7 percent in dry weight basis of the total weight of the slurry.

Preferably, the method of the invention comprises adding an aerosol-former to the material containing alkaloids. aerosol-formers may be introduced in the slurry.

Suitable aerosol-formers for adding to a material containing alkaloids such as homogenised tobacco material are known in the art and include, but are not limited to: monohydric alcohols like menthol, polyhydric alcohols, such as triethylene glycol, 1,3-butanediol and glycerin; esters of polyhydric alcohols, such as glycerol mono-, di- or triacetate; and aliphatic esters of mono-, di- or polycarboxylic acids, such as dimethyl dodecanedioate and dimethyl tetradecanedioate.

Examples of preferred aerosol-formers are glycerin and propylene glycol.

The material containing alkaloids may have an aerosol-former content of greater than about 3 percent on a dry weight basis. The material containing alkaloids may alternatively have an aerosol former content of between about 3 percent and about 30 percent by weight on a dry weight basis. More preferably, the aerosol-former is comprised between about 7 percent to about 25 percent of dry weight of the material containing alkaloids. More preferably, the aerosol-former is comprised between about 10 percent to about 25 percent of dry weight of the material containing alkaloids.

According to a second aspect, the invention relates to a method for the preparation of a material containing alkaloids, said method comprising: forming a mixture including a reducing sugar and particles of a material containing alkaloids; extruding the mixture, wherein extruding includes: feeding the mixture to an extruder; heating the mixture to a first temperature; cooling the mixture to a second temperature lower than the first temperature; discharging the mixture at the second temperature from the extruder; and wherein the cooling is carried out in a time comprised between about 2 seconds and about 60 seconds.

A mixture of particles of a material containing alkaloids and a reducing sugar is formed. This mixture is then extruded. When subjected to treatment in the extruder, the reducing sugar may react with the ammonia or ammonium containing compounds of the material containing alkaloids. Without willing to be bound by theory, in the conditions of method of the invention it is believed that the carbonyl group of the reducing sugar of the mixture may undergo so called Maillard reactions with the amino group of ammonia or of ammonium containing compounds of the material containing alkaloids, thus lowering their quantity.

In order to avoid, or at least to limit an undesired loss of other desired components of the material, and particularly of alkaloids such as nicotine, according to the invention the extrusion comprises a heating step of the mixture to a first temperature and a cooling step of the mixture from the first temperature to a second temperature lower than the first temperature, wherein the cooling is carried out in a time comprised between about 2 seconds and about 60 seconds.

In this way, the material discharged from the extruder may comprise a lower quantity of ammonia or ammonium containing compounds compared to the material containing alkaloids before the extrusion, without any undesired loss, or with a limited loss, of other components of the material, and particularly of alkaloids such as nicotine.

Thus, a material containing alkaloids having a desired composition that allows controlling the characteristics of the aerosol generated from said material may be obtained. Preferred characteristics of the method according to the second aspect of the invention have been already outlined with reference to the first aspect and are meant to be therefore applicable to it.

According to a third aspect, the invention relates to an aerosol forming article comprising a component prepared from the method according to the first or the second aspect of the invention.

The advantages of the third aspect have been already outlined with reference to the first and second aspects and are not repeated herewith.

Aerosol forming articles according to the present invention may be in the form of filter cigarettes or other smoking articles in which tobacco material is combusted to form smoke. The present invention additionally encompasses articles in which tobacco material is heated to form an aerosol, rather than combusted, and articles in which a nicotine-containing aerosol is generated from a tobacco material without combustion or heating.

Aerosol forming articles according to the invention may be whole, assembled aerosol forming articles or components of aerosol forming articles that are combined with one or more other components in order to provide an assembled article for producing an aerosol, such as for example, the consumable part of a heated smoking device.

An aerosol forming article may be an article that generates an aerosol that is directly inhalable into a user's lungs through the user's mouth. An aerosol forming article may resemble a conventional smoking article, such as a cigarette and may comprise tobacco. An aerosol forming article may be disposable. An aerosol forming article may alternatively be partially-reusable and comprise a replenishable or replaceable aerosol forming substrate.

An aerosol forming article may also include a combustible cigarette. In preferred embodiments, the aerosol forming—article may be substantially cylindrical in shape. The aerosol forming article may be substantially elongated. The aerosol forming article may have a length and a circumference substantially perpendicular to the length. The aerosol forming article may have a total length between approximately about 30 millimeters and approximately about 100 millimeters. The aerosol forming article may have an external diameter between approximately about 5 millimeters and approximately about 12 millimeters.

In all the aspects of the invention, preferably, the material containing alkaloids is a homogenized tobacco material. In such a case, the alkaloids contained in the material may comprise nicotine.

Preferably, the homogenized tobacco material is obtained in form of sheet by casting a slurry.

The homogenized tobacco sheet includes tobacco particles grinded from tobacco leaves (for example tobacco stem and lamina).

The homogenized tobacco sheet may also comprise a minor quantity of one or more of tobacco dust, tobacco fines, and other particulate tobacco by-products formed during the treating, handling and shipping of tobacco.

The tobacco present in the homogenized tobacco material may constitute the majority of the tobacco, or even substantially the total amount of tobacco present in the aerosol-generating article. The impact on the characteristics of the aerosol, such as its flavor, may derive predominantly from the homogenized tobacco material. It is preferred that the release of substances from the tobacco present in the homogenized tobacco material is simplified, in order to optimize use of tobacco. In the following, the term "tobacco particles" is used through the specification to indicate tobacco having a mean size per weight between about 0.02 millimetres and about 0.3 millimetres.

A web of homogenized tobacco material is preferably formed by a casting process of the type generally comprising casting a tobacco slurry onto a moving metal belt. Preferably, the cast web is dried to form a web of homogenized tobacco material and it is then removed from the support surface.

Specific embodiments of the invention will be further described, by way of example only, with reference to the accompanying drawings in which.

Figure 1:
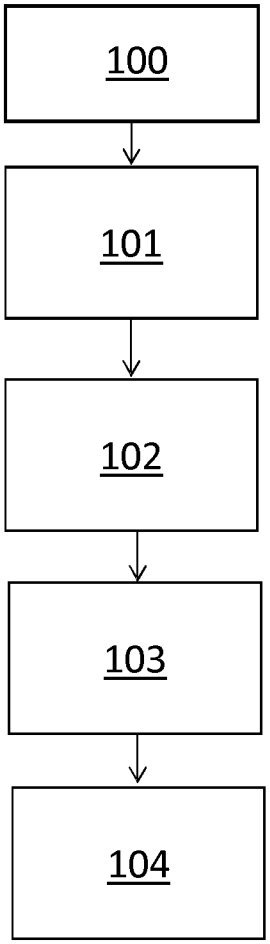
FIG. 1 shows a flow diagram of the method of the invention to produce a material containing alkaloids.

With initial reference to FIG. 1, a method for the production of a material containing alkaloids is represented. The first step 100 of the method of the invention is the formation of a mixture of particles of a material containing alkaloids and a reducing sugar. Preferably, the material containing alkaloids is a tobacco material containing the alkaloid nicotine. The mixture of reducing sugar and tobacco material may have a water content between about 11 percent and about 14 percent per weight on dry weight basis of the mixture.

Figure 2:
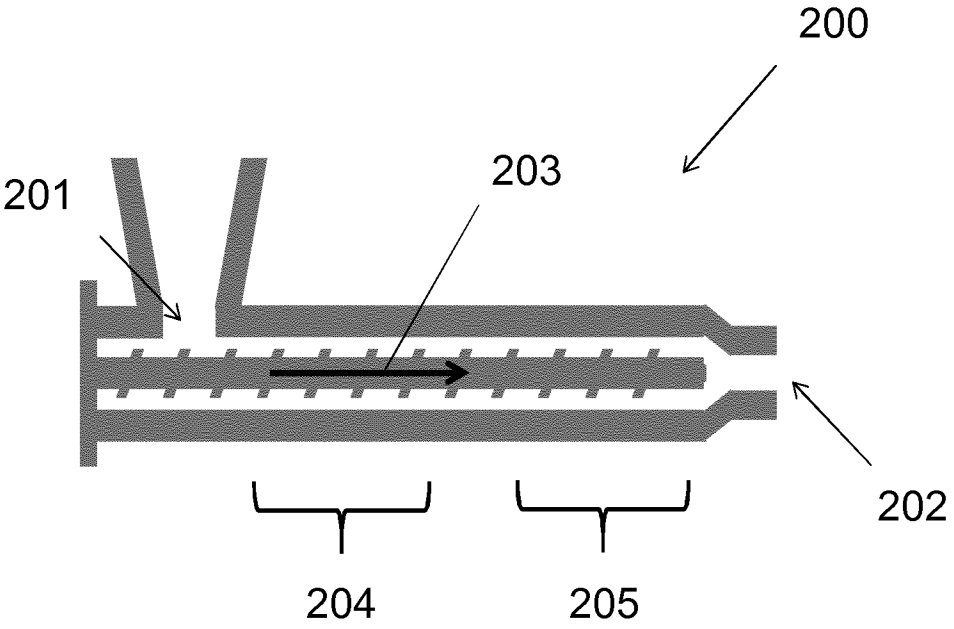
FIG. 2 shows a schematic lateral view of an extruder used in the method of the invention to produce a material containing alkaloids.

The method includes a further step 101 in which the mixture is fed to an extruder 200 (represented in FIG. 2) including an inlet 201 and an outlet 202. In the extruder 200, the mixture moves from the inlet 201 and the outlet 202 along a direction of extrusion indicated in FIG. 2 by arrow 203 and is subjected to a thermo-mechanical treatment during which the reducing sugar preferably undergoes to a reaction with the ammonia and the ammonium containing compounds of the tobacco material. Preferably, during extrusion a mechanical energy between about 225 watt-hour per kilogram of the mixture and about 275 watt-hour per kilogram of the mixture is applied to the mixture present in the extruder.

Figure 3:
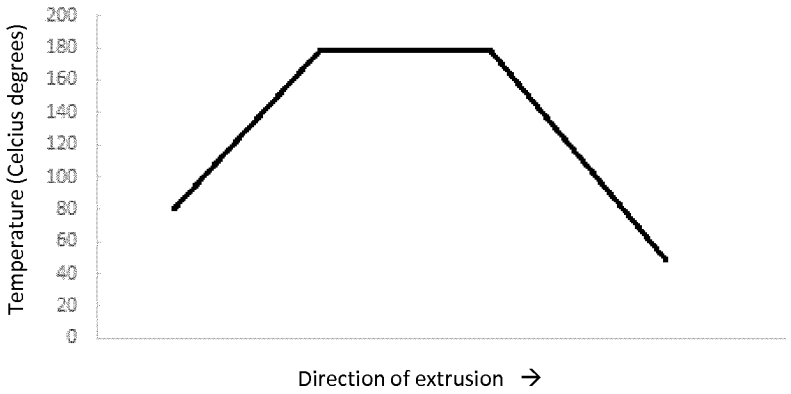
FIG. 3 shows a thermal profile of an extruder used in the method of the invention to produce a material containing alkaloids.

In FIG. 3 is shown a schematic thermal profile along the direction of extrusion 203 of an extrusion process of the method of the invention.

The extrusion step of method of the invention includes a step 102 of heating the mixture present inside the extruder 200 to a first temperature lower than or equal to about 190 Celsius degrees. Preferably, the first temperature is between about 90 Celsius degrees and about 190 Celsius degrees, more preferably between about 140 Celsius degrees and about 190 Celsius degrees, even more preferably between about 175 Celsius degrees and about 185 Celsius degrees. Preferably, heating is carried out in a first part 204 of the extruder 200. Preferably, the residence time in the first part of the extruder is between about 18 seconds and about 22 seconds.

After the step 102 of heating the mixture to a first temperature, a further step 103 of cooling the mixture present inside the extruder 200 from the first temperature to a second temperature lower than or equal to about 70 Celsius degrees is performed. Preferably, the second temperature is between about 30 Celsius degrees and about 70 Celsius degrees, more preferably between about 35 Celsius degrees and about 50 Celsius degrees, even more preferably between about 35 Celsius degrees and about 45 Celsius degrees. Preferably, cooling is carried out in a second part 205 of the extruder 200, downstream to the first part 204 of the extruder 200 in the direction of extrusion 203. Preferably, the residence time in the second part 205 of the extruder is between about 18 seconds and about 22 seconds.

The extruder is "divided" longitudinally in two preferably continuous parts, the first part 204 where the heating takes place and the second part 205 where the cooling takes place. The second part is positioned downstream of the first part in the direction of extrusion, that is the direction of the mean resulting velocity of the mixture in the extruder.

As shown in FIG. 3, the extrusion process may include keeping the mixture at the first temperature, preferably within the first part 204 of the extruder 200, in particular in a sub-portion of the first part 204, preferably at the end of the first part, for a certain residence time before the step of cooling the mixture. Preferably, this residence time is between about 7 seconds and about 11 seconds.

After the step 103 of cooling the mixture from the first temperature to a second temperature, a further step 104 of discharging the mixture, for example at the second temperature, from the extruder 200 is performed. In this way, a tobacco material having a lower quantity of ammonia or ammonium containing compounds compared to the tobacco material before the extrusion process.

Downstream to step 104 in the process line, the tobacco material discharged from the extruder may be combined with a binder and/or an aerosol former to form a slurry which may be homogenised and then cast to form an homogenous tobacco material in form of cast sheet.

The invention claimed is:

1. A method for the preparation of a material containing alkaloids, said method comprising:
- forming a mixture comprising a reducing sugar and particles of a material containing alkaloids;
- extruding the mixture, wherein extruding includes:
  - feeding the mixture to an extruder;
  - heating the mixture to a first temperature lower than or equal to about 190 Celsius degrees;
  - cooling the mixture from the first temperature to a second temperature lower than or equal to about 70 Celsius degrees; and
  - discharging an extruded mixture from the extruder;
- wherein the mixture has a residence time in the extruder comprised between about 10 seconds and about 80 seconds.

2. The method according to claim 1, wherein the mixture before the step of extruding comprises between about 2 percent and about 30 percent per weight of reducing sugar, on dry weight basis of the mixture.

3. The method according to claim 1, wherein the reducing sugar is selected from glucose, fructose, xylose, ribose, galactose, and mixtures thereof.

4. The method according to claim 1, wherein the mixture has a water content of between about 2 percent and about 30 percent per weight before the step of extruding.

5. The method according to claim 1, wherein the first temperature is between about 90 Celsius degrees and about 190 Celsius degrees.

6. The method according to claim 1, wherein the second temperature is between about 30 Celsius degrees and about 70 Celsius degrees.

7. The method according to claim 1, wherein heating is carried out in a first part of the extruder and cooling is carried out in a second part of the extruder, the second part of the extruder being downstream to the first part of the extruder in the direction of extrusion.

8. The method according to claim 7, wherein the mixture has a residence time in the first part of the extruder comprised between about 2 seconds and about 60 seconds.

9. The method according to claim 7, wherein the mixture has a residence time in the second part of the extruder comprised between about 2 seconds and about 60 seconds.

10. The method according to claim 1, wherein the extrusion process includes keeping the mixture at the first temperature for a residence time between about 2 seconds and about 55 seconds before the step of cooling the mixture.

11. The method according to claim 1, wherein extruding is performed by applying a mechanical energy between about 150 watt-hour per kilogram of the mixture and about 350 watt-hour per kilogram of the mixture.

12. The method according to claim 1, comprising:
- combining the material containing alkaloids with a binder to form a slurry;
- homogenizing the slurry; and
- casting the slurry.

13. A method for the preparation of a material containing alkaloids, said method comprising:
- forming a mixture of particles of a material containing alkaloids and a reducing sugar;
- extruding the mixture, wherein extruding includes:
  - feeding the mixture to an extruder;
  - heating the mixture to a first temperature;
  - cooling the mixture to a second temperature lower than the first temperature;
  - discharging the mixture at the second temperature from the extruder;
- wherein the cooling is carried out in a time comprised between about 2 seconds and about 60 seconds and wherein the mixture has a residence time in the extruder comprised between about 10 seconds and about 80 seconds.

14. The method according to claim 13, wherein the mixture before the step of extruding comprises between about 2 percent and about 30 percent per weight of reducing sugar, on dry weight basis of the mixture.

15. The method according to claim 13, wherein the reducing sugar is selected from glucose, fructose, xylose, ribose, galactose, and mixtures thereof.

16. The method according to claim 13, wherein the mixture has a water content of between about 2 percent and about 30 percent per weight before the step of extruding.

17. The method according to claim 13, wherein the first temperature is lower than or equal to about 190 Celsius degrees.

18. The method according to claim 13, wherein the second temperature is lower than or equal to about 70 Celsius degrees.

19. The method according to claim 13, wherein heating is carried out in a first part of the extruder and cooling is carried out in a second part of the extruder, the second part of the extruder being downstream to the first part of the extruder in the direction of extrusion.

20. The method according to claim 13, wherein the extrusion process includes keeping the mixture at the first temperature for a residence time between about 2 seconds and about 55 seconds before the step of cooling the mixture.

21. The method according to claim 13, wherein extruding is performed by applying a mechanical energy between about 150 watt-hour per kilogram of the mixture and about 350 watt-hour per kilogram of the mixture.

22. The method according to claim 13, comprising:
- combining the material containing alkaloids with a binder to form a slurry;
- homogenizing the slurry; and
- casting the slurry.

* * * * *